United States Patent [19]

Wallace et al.

[11] 4,403,532

[45] Sep. 13, 1983

[54] RATCHET NUTRUNNER WITH AUDIBLE TORQUE SIGNAL

[75] Inventors: William K. Wallace, Barneveld; David A. Giardino, Deerfield, both of N.Y.

[73] Assignee: Chicago Pneumatic Tool Company, New York, N.Y.

[21] Appl. No.: 305,126

[22] Filed: Sep. 24, 1981

[51] Int. Cl.[3] ..... B25B 23/142

[52] U.S. Cl. ..... 81/483; 81/57.11

[58] Field of Search ..... 81/467, 478, 480, 481, 81/483, 473, 474, 477, 57.11, 57.13; 173/12; 73/868.21

[56] References Cited

U.S. PATENT DOCUMENTS 2,663,209 12/1953 Gummere et al. ..... 81/57.13
2,740,507 4/1956 Shaff ..... 81/57.11
3,939,924 2/1976 Grabovae ..... 81/57.11
4,265,108 5/1981 Wallace et al. ..... 73/862.21

*Primary Examiner*—James L. Jones, Jr.
*Attorney, Agent, or Firm*—Stephen J. Rudy

[57] ABSTRACT

A pneumatically powered hand-held torque wrench having a handle portion which can be forced out of axial alignment with a work engaging end of the tool by manual force applied to the handle portion of the tool, whereby an enclosed torque tube will operate through a cam arrangement to cause the inner surface of the handle portion to move with a snap action into contact with one of the cams in the cam arrangement to cause an audible signal which will indicate to the operator that a predetermined torque has been applied to the set fastener. The snap action is accompanied by a slight slipping action which is sensed by the tool operator.

8 Claims, 8 Drawing Figures

FIG. 4
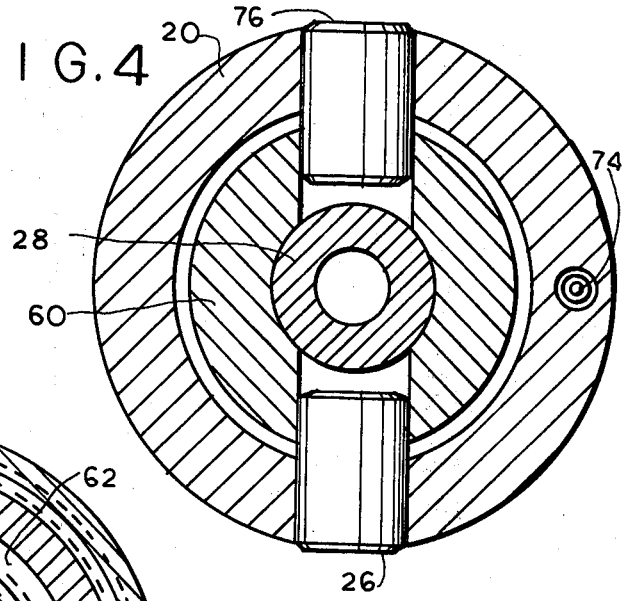
FIG. 5
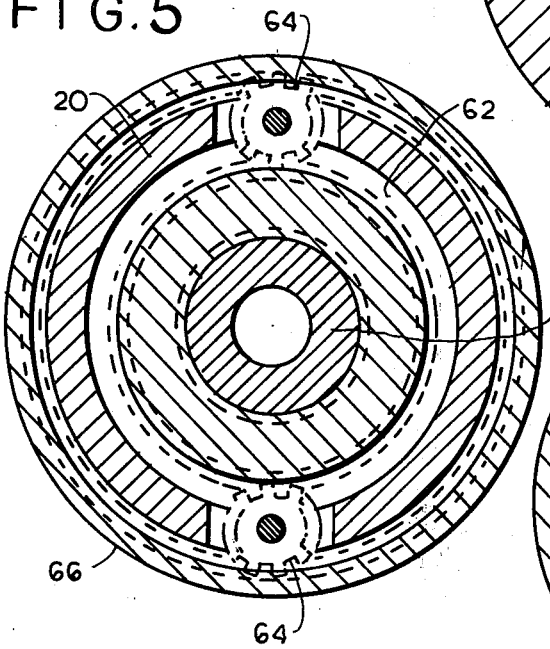
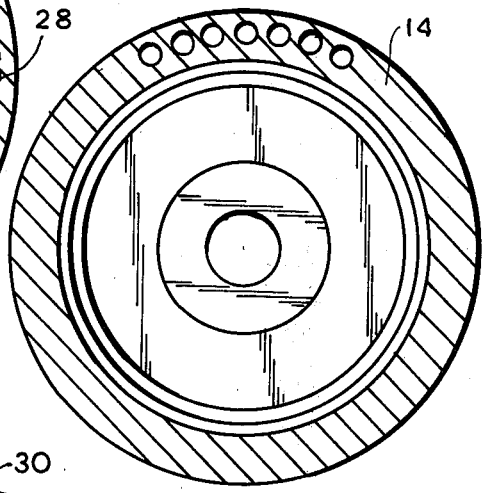
FIG. 3
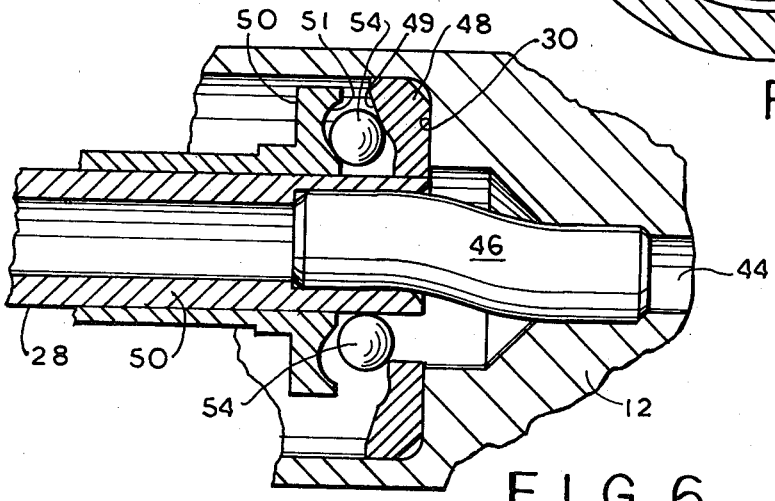
FIG. 6

RATCHET NUTRUNNER WITH AUDIBLE TORQUE SIGNAL

BACKGROUND OF THE INVENTION

This invention relates to a pneumatically powered hand-held nutrunner having means to provide an audible signal when a predetermined set torque is attained.

Nutrunners of the type concerned herein have embodied a variety of mechanical arrangements to achieve the desired end result, one type being disclosed in U.S. Pat. No. 3,939,924, issued on Feb. 24, 1976 to Bosko Grabovac. Such a nutrunner utilizes pneumatic pressure fluid to quickly run up a fastener, with final torquing being manually applied by the tool operator, which final torque value attainment is indicated by an audible signal.

The primary object of the subject invention is to provide a power operated nutrunner wherein predetermined final torque value is manually attained and indicated by an audible signal accompanied by a slip which is sensed by the tool operator.

Another object is to provide a power operated nutrunner wherein torque setting readout is positively indicated at any stage within the preset range of tool torque output.

A further object of the invention is to provide a power operated nutrunner which achieves the primary objective with a tool of compact design, simplicity of structure, and which is of reliable operation.

These and further objects and features of the invention will become apparent from an understanding of the description of a preferred embodiment disclosed in the following description and appended drawings.

BRIEF DESCRIPTION OF THE DRAWINGS

FIG. 3 is an enlarged section view as seen from line 3—3 in FIG. 1;

FIG. 4 is a further enlarged section view as seen from line 4—4 in FIG. 2;

FIG. 5 is a further enlarged section view as seen from line 5—5 in FIG. 2;

FIG. 6 is a further enlarged section view showing primarly a cam element used in the tool of FIG. 1;

DESCRIPTION OF PREFERRED EMBODIMENT

Figure 1:
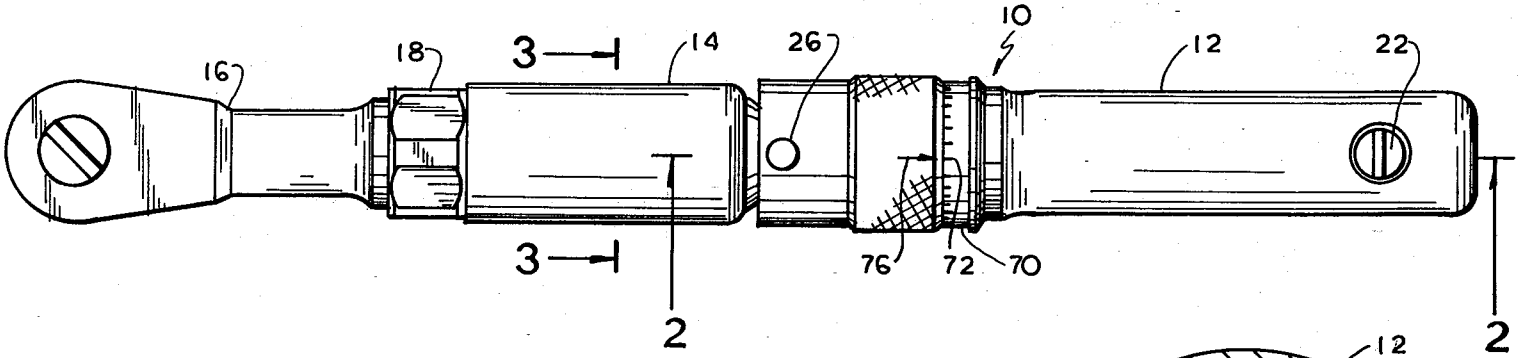
FIG. 1 is a top view of a tool embodying the invention.

Referring now to the drawings, numeral 10 identifies a pneumatically powered hand-held nutrunner embodying the invention. The tool includes a handle portion 12, a motor housing portion 14 and a work engaging portion 16 all portions being in axial alignment when the tool is in non-operative condition. The portions 14 and 16 include structural detail, such as disclosed in our prior U.S. Pat. No. 4,265,108 issued on May 5, 1981, which patent provides sufficient information for a full understanding of the present invention. The work engaging portion 16 is threadably affixed to the motor portion 14 by a hexagonal nut 18, and otherwise incorporates the mechanism as disclosed in U.S. Pat. No. 4,265,108, including operative driving connection with a vane motor located in the motor portion 14.

The handle portion 12 is formed to provide a cylindrical housing 20, one end of which is enclosed and arranged to contain a valve means 22, the other end being open and mounted upon a rear end extension 24 of the motor portion 14, and secured thereto by two axially arranged pins 26. Slight clearance is provided between the end of the housing 20 and the extension 24 to allow a change in axial alignment between said parts when a torquing force is applied to the handle portion 12. If the housing portion is made of material sufficiently flexible under normal force, the handle portion can be affixed to the motor portion without the need for pivot pins or the indicated clearance between the adjacent parts.

A torque tube 28 extends axially within the housing 20, one end of which is securely mounted in the extension 24 of the motor housing 24, the other end terminating in close proximity to a cam abutment surface 30 formed in the valve end of the housing. The valve means 22 includes a throttle valve 32 slidably arranged in passageway 34, one end of the valve projecting outside the housing, the other end being engaged by a compression spring 36 to urge the valve into seated position. The throttle valve may be unseated by action thereupon of a throttle lever 38 pivotally affixed to the housing. An air hose opening 40 is provided in the end of the housing for receipt of an air hose (not shown) whereby live air may flow through a passageway 42, past the unseated throttle valve and into a axially arranged passageway 44.

A flexible tube 46, which may be formed from a plastic material, interconnects the passageway 44 and the torque tube 28. In such manner compressed air can be fed to the motor in the motor housing 14 for operation of the work engaging mechanism 16 during a nutrunning-up operation.

Figure 8:
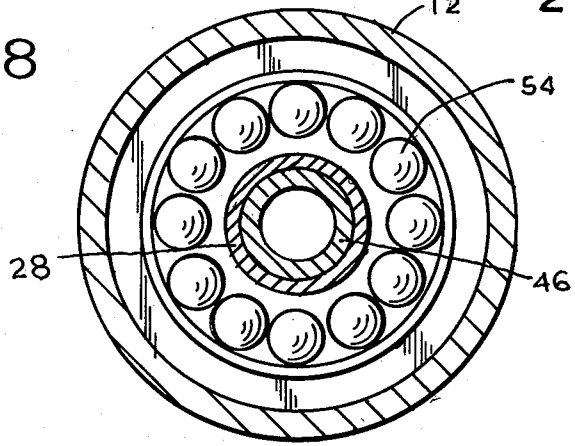
FIG. 8 is an enlarged section view as seen from line 8—8 in FIG. 2.
Figure 2:
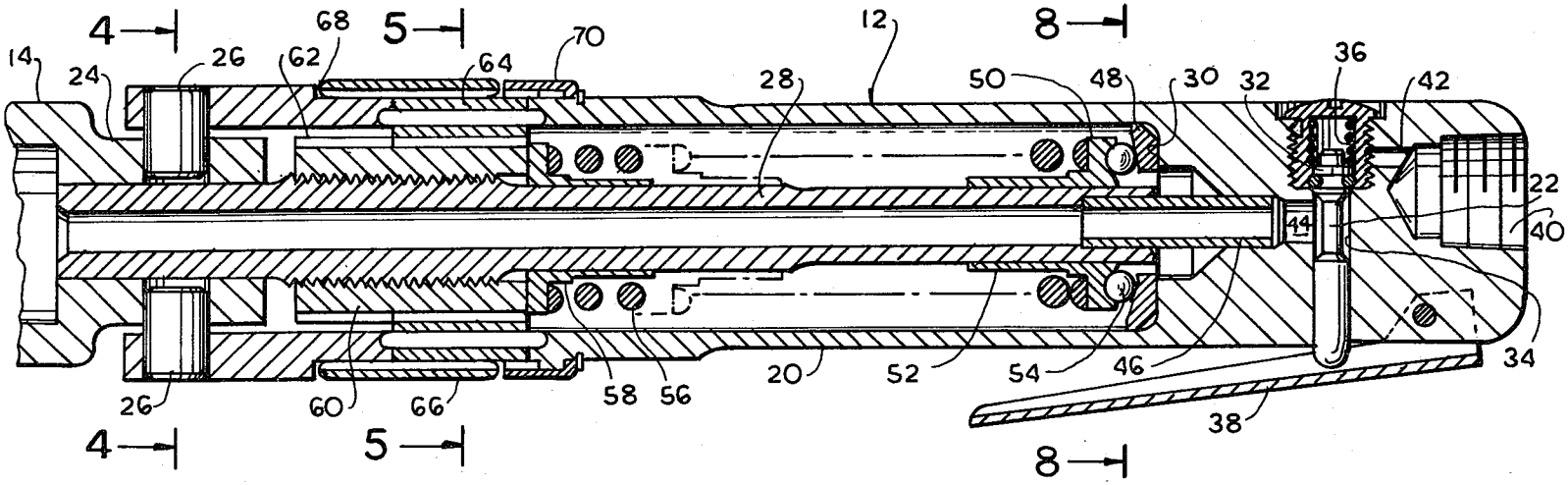
FIG. 2 is an enlarged section view as seen from line 2—2 in FIG. 1.

A disc cam 48, arranged within the housing, and is seated upon the cam abutment surface 30. Adjacent thereto is a complementary cam 50 which forms one end of a sleeve 52 slidably mounted upon the torque tube 28. A plurality of balls 54 (FIG. 8) are confined within the space separating the cams 48 and 50, which balls ride upon cam surface 49 and 51 respectively. The cam 50 is urged toward the cam 48 by a helical spring 56 compressively arranged between the outer surface of the cam 50 and a spring guide 58 slidably supported upon the torque tube 28. The spring guide is arranged in abutment with an adjusting nut 60 threadably secured to the torque tube 28. The nut has spur gear teeth 62 about its periphery which are arranged to mesh with diametrically arranged idler gears 64 rotatably supported in the housing 20, as best seen in FIG. 2.

Figure 7:
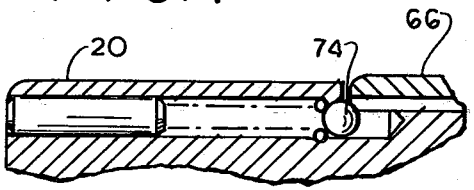
FIG. 7 is a section view of a detent arrangement used in the tool of FIG. 1.

A ring gear 66 is arranged in a peripheral groove 68 formed on the housing 20, which gear has internal teeth which mesh with the idler gears 64, and may be rotated for regulation of compressive condition of the helical spring 56, by action through the adjusting nut 60 and spring guide 58. A vernier gear 70, providing a torque readout ring, is arranged for engagement with the idler gears 64, and has indicia 72 (FIG. 1) which indicate the rotational setting of ring gear 66, thereby providing an indication of the degree of compression of the cam spring 56, and resulting torque setting. To assist in maintaining the ring gear 66 in set position, a detent ball 74 is spring loaded to engage the end of the teeth on the ring gear 66, as best seen in FIG. 7. A pointer, or base mark 76, is provided on the exterior of the ring gear 66 (FIG. 1).

The vernier gear 70 turns relative to the ring gear 66, when the latter is rotated. Such differential motion is produced by a difference in the number of gear teeth on each ring. The gear 70 has 63 teeth, while the gear 66 has 61 teeth. Such arrangement produces a relative movement between the rings of 11° per revolution of the gear 66.

The feature of such differential gearing employed in the tool of the invention is that the ring gear 66 will be revolved through 360°, approximately thirty-three times, while the vernier gear ring will simultaneously be revolved through 360° only once. If the ring gear were rotated around fixed indicia on the tool, such as where such differential gearing was not employed, the tool operator would not be able to accurately determine the torque setting achieved by rotation of the ring gear 66, since there would be no indication as to how many times a given indicia was passed by the ring gear base mark 76.

The operation of the nutrunner of the invention will now be explained. Assume the work end 16 is engaging a fastener (not shown) to be set, the throttle lever 38 is depressed by the operator and compressed air flows to the motor portion 14, whereupon the fastener is rotated. When the fastener is seated the motor will stall, and the operator will rotate the fastener to final torque by applying force to the tool handle 12. The hinged connection between the handle portion 12 and the motor portion 14, results in load being transferred to the torque tube 28, through cam 48, balls 54 and cam 50. Torque to the fastener is then transferred through the torque tube 28, motor housing 14 and work engaging portion 16.

As operator force on the handle 12 increases, cam 48 causes an axial load to be applied to the cam 50, via the balls 54. The spring 56 resists axial movement of the cam 50, until the balls 54 roll over the change of contact angle formed on the cam 48. In such position the ability of the spring 56 to resist movement of cam 50, is overcome, and the cam 50 is moved axially away from cam 48. The handle 12 moves relative to the torque tube 28 with snap-action as the balls 54 roll up the cam surfaces 49 and 51. At this point a slip is felt by the tool operator and an audible click is made when the cam 48 hits the torque tube 28 (FIG. 6). This signals the operator that the pre-selected torque has been realized. As will be seen in FIG. 6, the flexible tube 46 will bend to accomodate handle portion movement.

When operator load on the handle is released, the spring 56, moves the cam 50 toward original position, and the balls 54 move along the cam surfaces 49 and 51 to original position.

Preset torque cut-off selection is accomplished by rotation of the ring gear 66 to regulate degree of compression of the spring 56. The greater the degree of compression the higher the preset torque will be. It will be evident that the tool will provide torque readout in either forward or reverse direction, and with or without pressurized air being supplied to the tool.

While an embodiment of the invention has been illustrated and described in detail, it is to be expressly understood that the invention is not limited thereto. Various changes in form, design or arrangement may be made in its parts without departing from the spirit and scope of the invention; it is our intention, therefore, to claim the invention not only as shown and described, but also in all such forms and modifications thereof as might be reasonably construed to be within the spirit of the invention and the scope of the appended claims.

What is claimed is:

1. In a pneumatically powered hand-held tool for setting fasteners, said tool having in axial alignment a handle portion, a motor portion flexibly affixed to the handle portion, and a work engaging portion, an improvement comprising an audible signal means to indicate to the tool operator when preset torque is attained in a fastener setting operation, said signal means including a torque tube enclosed in the handle portion and arranged to conduct pneumatic medium through the handle portion to the motor portion, said torque tube being secured at one end to an extension of the motor housing the other end being unattached and extending axially in the handle portion in spaced relation thereto, and a cam means provided at the free end of the torque tube, said cam means being arranged to cause snap action movement of the handle portion toward contact with the torque tube when a predetermined torque load is applied to a fastener being operated upon.

2. In a pneumatically powered hand-held tool according to claim 1, wherein said cam means includes a disc cam which is affixed within the handle portion, a complementary cam which is slidably arranged upon the torque tube, and a plurality of balls separating said cams and disposed in cam raceways formed on adjacent surfaces of the cams.

3. In a pneumatically powered hand-held tool according to claim 2, wherein a spring is arranged to urge the complementary cam toward the disc cam.

4. In a pneumatically powered hand-held tool according to claim 3, wherein spring compression adjusting means are provided to set the spring compression at any given value within a predetermined range.

5. In a pneumatically powered hand-held tool according to claim 4, wherein said adjusting means includes an adjusting nut which is threadably mounted upon the torque tube, a ring gear mounted upon the handle portion and having internal gear teeth, and idler gears arranged between the ring gear and the adjusting nut whereby rotation of the ring gear will cause rotation of the adjusting nut and regulate the compression of the spring.

6. In a pneumatically powered hand-held tool according to claim 5, wherein a vernier gear is rotatably mounted upon the handle portion adjacent the ring gear, said vernier gear having teeth which are in meshing engagement with the teeth of said idler gears, and having torque setting indicia on the periphery thereof.

7. In a pneumatically powered hand-held tool according to claim 6, wherein the number of teeth on the vernier gear differs from the number of teeth on the ring gear to provide differential movement there-between when the ring gear is rotated.

8. In a pneumatically powered hand-held tool according to claim 7, wherein a base mark is provided upon the surface of the ring gear which mark is arranged adjacent the indicia on the vernier ring to indicate torque setting of the tool.

* * * * *